US006938583B2

(12) United States Patent
Wood

(10) Patent No.: US 6,938,583 B2
(45) Date of Patent: Sep. 6, 2005

(54) BLOWDOWN HEAT RECOVERY

(75) Inventor: Stewart J. Wood, 6399 Olde Drive, Appin, Ontario (CA), N0L 1A0

(73) Assignee: Stewart J. Wood, Appin (CA)

( * ) Notice: Subject to any disclaimer, the term of this patent is extended or adjusted under 35 U.S.C. 154(b) by 0 days.

(21) Appl. No.: 10/605,830

(22) Filed: Oct. 29, 2003

(65) Prior Publication Data

US 2004/0194735 A1 Oct. 7, 2004

(30) Foreign Application Priority Data

Dec. 17, 2002 (CA) ..... 2414611

(51) Int. Cl.[7] ..... F22D 1/00
(52) U.S. Cl. ..... 122/414
(58) Field of Search ..... 122/7 R, 414, 122/422, 488, 489

(56) References Cited

U.S. PATENT DOCUMENTS 3,026,043 A * 3/1962 Johnson et al. ..... 237/67
4,285,302 A * 8/1981 Kelly ..... 122/382
4,393,816 A * 7/1983 Bock ..... 122/412
4,428,328 A 1/1984 Ratliff
4,465,026 A * 8/1984 Carberry ..... 122/382
6,655,322 B1 * 12/2003 Godwin et al. ..... 122/379

* cited by examiner

*Primary Examiner*—Gregory Wilson
(74) *Attorney, Agent, or Firm*—Marks & Clerk; Richard J. Mitchell

(57) ABSTRACT

A method of recovering heat energy during blowdown of a steam boiler is described wherein thermal energy is recovered both from flash steam produced by blowdown water and the blowdown water itself. The flash steam is preferably condensed in the feedwater (or any open vented water tank) so as to recover the water volume of the flash steam in addition to its heat energy.

15 Claims, 4 Drawing Sheets

BLOWDOWN HEAT RECOVERY

BACKGROUND OF INVENTION

The present invention relates to a method an apparatus for the recovery of heat from a steam boiler, and more particularly to a unit which is useful in connection with a steam boiler to recover thermal energy from the flash steam water and from sensible heat left in the boiler water.

Boilers are used to generate steam by boiling water. The water within the boiler which remains after steam has been generated will be subject to the concentrating effect of minerals and other contaminants in the water which will not pass into the steam phase. If over concentration of dissolved impurities occurs, scale forms and thermal efficiency is lost. To prevent over concentration in steam generation processes, water must be periodically removed from the steam boiler. The process of removing dissolved impurities is called blowdown. A volume of concentrated boiler water is removed and then subsequently replaced by higher purity boiler feedwater which naturally is cooler than the water which was in the boiler. This process occurs throughout the operation cycle of the boiler.

Boilers produce steam under pressure. The higher the pressure, the greater the temperature. In the prior art, when the blowdown process is executed, the hot boiler water at operating pressure is piped to a blowdown tank. The change in pressure between operating pressure and atmospheric pressure, results in the formation of a steam plume. The size of this plume is dependent upon the operating pressure and temperature. The higher the pressure, the greater the plume that is generated.

In most applications, such as the one disclosed in the U.S. Pat. No. 4,428,328, to Ratliff, this plume is released in a vessel called a flash tank or a blowdown tank. Flash tanks, except for very high-pressure applications are generally open to atmosphere. Thus, the flash steam and the heat contained therein is lost to the surrounding atmosphere. As that happens, the heat energy reserved in the flash steam is wasted.

Once the flash steam has been released, it is the practice in the prior art to send the remaining mass of blowdown water to sewer, via a heat exchanger, where energy is transferred from the blowdown water to the feedwater which is being added to the boiler.

Other devices and apparatus have been proposed which benefit from the thermal energy contained in the flash steam at the expense of wasting the energy contained in the blowdown water.

To overcome the limitations of the prior art described above, and to overcome other limitations that will become apparent upon reading and understanding the present specification, the present invention provides a cost effective method and simplified means for combining the two fundamental elements which prevent the loss of energy during the necessary process of blowing down steam boilers to prevent scale formation. The present invention recovers the heat from both the blowdown water and the flash steam.

SUMMARY OF INVENTION

According to the present invention there is provided a method of recovering heat energy during blowdown of a steam boiler, comprising providing a supply of feedwater to replenish water in said steam boiler during blowdown; removing blowdown water from said steam boiler; producing flash steam from said blowdown water; transferring thermal energy contained in said flash steam to a mass of water; and transferring thermal energy in said blowdown water remaining after production of said flash steam to said feedwater.

The mass of water could be the feedwater itself or it could be other water contained in an open vented water tank.

It will be appreciated that fresh water originates from a well or city water supply. This is known as make-up water. This water is heated by heat from the blowdown water and flows into the feedwater tank, where it becomes known as feedwater. The transfer of thermal energy from the blowdown water preferably takes place directly to the make-up water, which then carries this energy into the feedwater tank.

In one embodiment the flash steam actually condenses in the feedwater so that both the thermal energy contained in the steam (consisting of the latent heat of condensation and sensible heat) and the water volume itself are recovered.

The invention is capable of providing an apparatus which is readily attached to a steam boiler, particularly as a separate unit, to facilitate the recovery of thermal energy during the blowdown operation.

The invention presents the transfer of heat energy from the blowdown water from a boiler to fresh make-up water and feedwater to be added to the boiler.

The invention also presents the advantage of recovering all of the thermal energy from the flash steam.

A further advantage of the invention is that it provides way of recovering water volume during the blowdown operation. This water volume is obtained from the water vapor in the flash steam.

Still, an additional advantage of the invention is that it does not required a separate heat exchanger. All components can be combined into one simplified vessel so that the heat transfer process is accomplished in one atmospheric tank. This works against the potential for uncontrolled loss of thermal energy due to having to maintain level control, and thus discharging water separate from a heat exchanger.

Moreover, an advantage of this invention is to provide water level control that is efficient to preserving thermal energy by removing water from the bottom of the reservoir versus removing the hotter water from the top gradations.

In another aspect the invention provides a blowdown apparatus for use with a steam boiler, comprising a blowdown recovery vessel for containing blowdown water from the steam boiler; a feedwater tank for containing a supply of feedwater to replenish water in the steam boiler; a heat exchanger for transferring heat energy from said blowdown water to make-up water flowing into said feedwater tank; a flash tank for producing flash steam from said blowdown water; and a conduit for directing said flash steam into a tank containing a mass of water so as to transfer heat energy contained in said flash steam to said mass of water.

BRIEF DESCRIPTION OF DRAWINGS

The invention will now be described in more detail, by way of example only, with reference to the accompanying drawings, in which.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
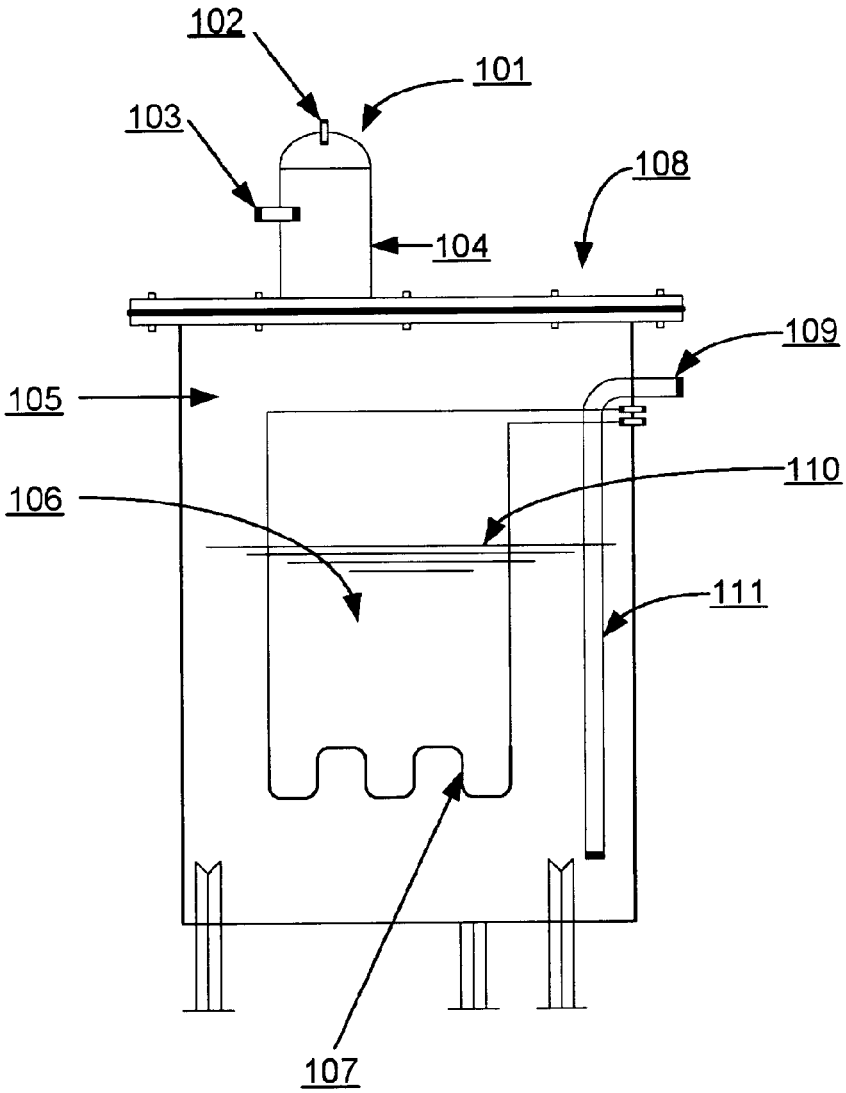
FIG. 1 is a side view of one embodiment of the blowdown heat recovery vessel for use in the present invention.

A blowdown heat recovery vessel 108 is shown in FIG. 1. This includes a storage chamber 105 for containing a blowdown mass 106 from a boiler up to a water level 110 and a heat transfer coil 107. The blowdown recovery vessel 108 also includes an overflow conduit 111 extending from near the bottom of the vessel and terminating in a drain 109.

A flashtank 104 with vent 103 and providing a flash chamber 101 is mounted on top of the blowdown recovery vessel 108.

Figure 2:
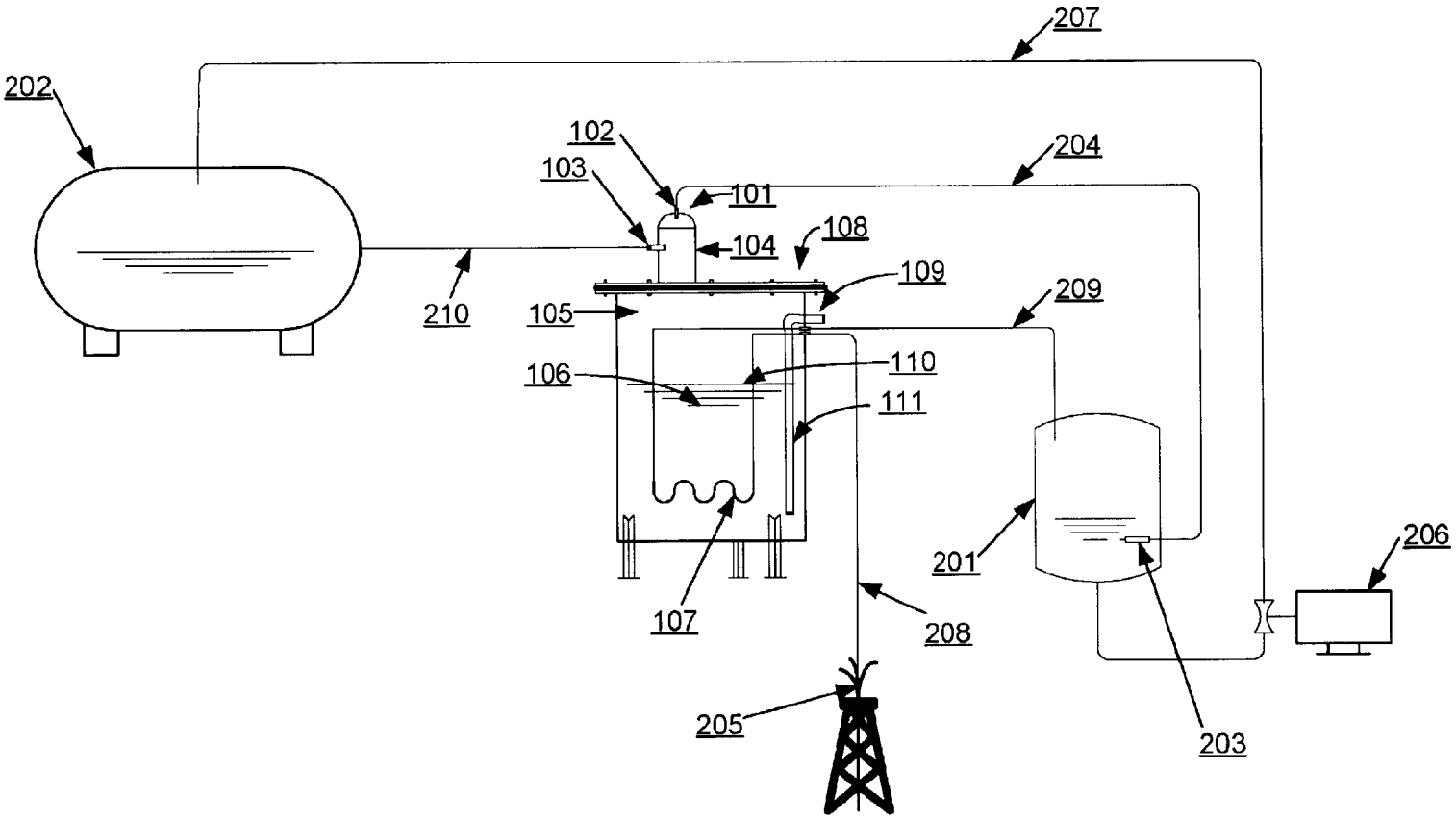
FIG. 2 illustrates the operation according to one embodiment of the present invention.

A complete blowdown recovery system is shown in FIG. 2. Boiler 202 is supplied with feedwater from feedwater tank 201 via conduit 207. The boiler is also connected to the flashtank 104 mounted on the blowdown recovery vessel 108 by conduit 210. During normal operation the boiler 202 is supplied with a source of heat (not shown) and generates steam in a conventional manner.

After a certain amount of time when the mineral content of the boiler water has started to build up, the blowdown recovery process is started. Blowdown water from the boiler 202 is directed into flash chamber 101 via a conduit 210 and a nozzle 103. In this section, the blowdown mass is forced around the inside diameter of the vessel 104. The vessel 104 is vented to atmosphere through a vent (not shown) on the feedwater tank 202 so that its interior remains at atmospheric pressure. As a result, flash steam is released through a flash steam exit nozzle 102. This steam is directed, via a conduit 204, to a steam muffler 203 installed below the water line in boiler the feedwater tank 201. As a result, the flash steam condenses in the cooler feedwater and the thermal energy contained in the flash steam and water vapor is transferred to the boiler feedwater, resulting in the recovery of water from the steam and the thermal energy resulting from its latent heat and sensible heat in the condensed water. However, the flash steam could also be condensed in a separate mass of water contained in an open vented tank.

The remaining blowdown mass that does not flash off to steam drops into the storage section 105 of the blowdown heat recovery vessel 108 (hereinafter referred to as BHR vessel). In this section, cooler make-up water 205 (typically well water or city water) is passed via a conduit 208 to a heat transfer device in the blowdown recovery vessel 108, in example a heat transfer coil 107 in the blowdown recovery vessel 108. It will be understood that other suitable forms of heat transfer device could be employed.

The make-up water 205 subsequently passes through the heat transfer coil 107 taking in sensible heat retained in the boiler blowdown mass 106. This make-up water 205, after picking up thermal energy, is passed to a boiler feedwater tank 201 at an elevated temperature via a conduit 209.

After the feedwater acquires additional heat energy and water volume in the feedwater tank 201, a boiler feedwater pump 206 pumps the heated feedwater into the steam boiler 202 via conduit 207 on demand from the steam boiler 202.

Figure 3:
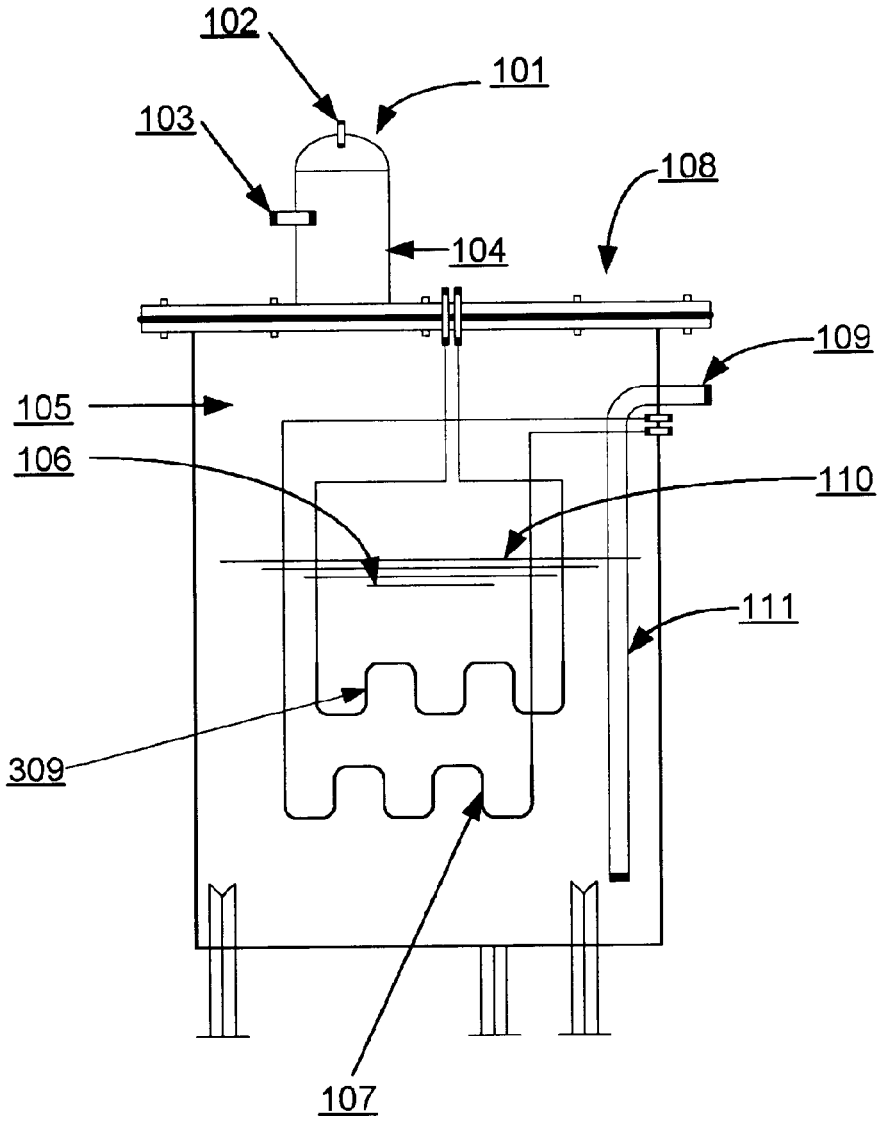
FIG. 3 is a side view of another embodiment of the blowdown heat recovery vessel utilizing a second heating coil for use in the present invention.
Figure 4:
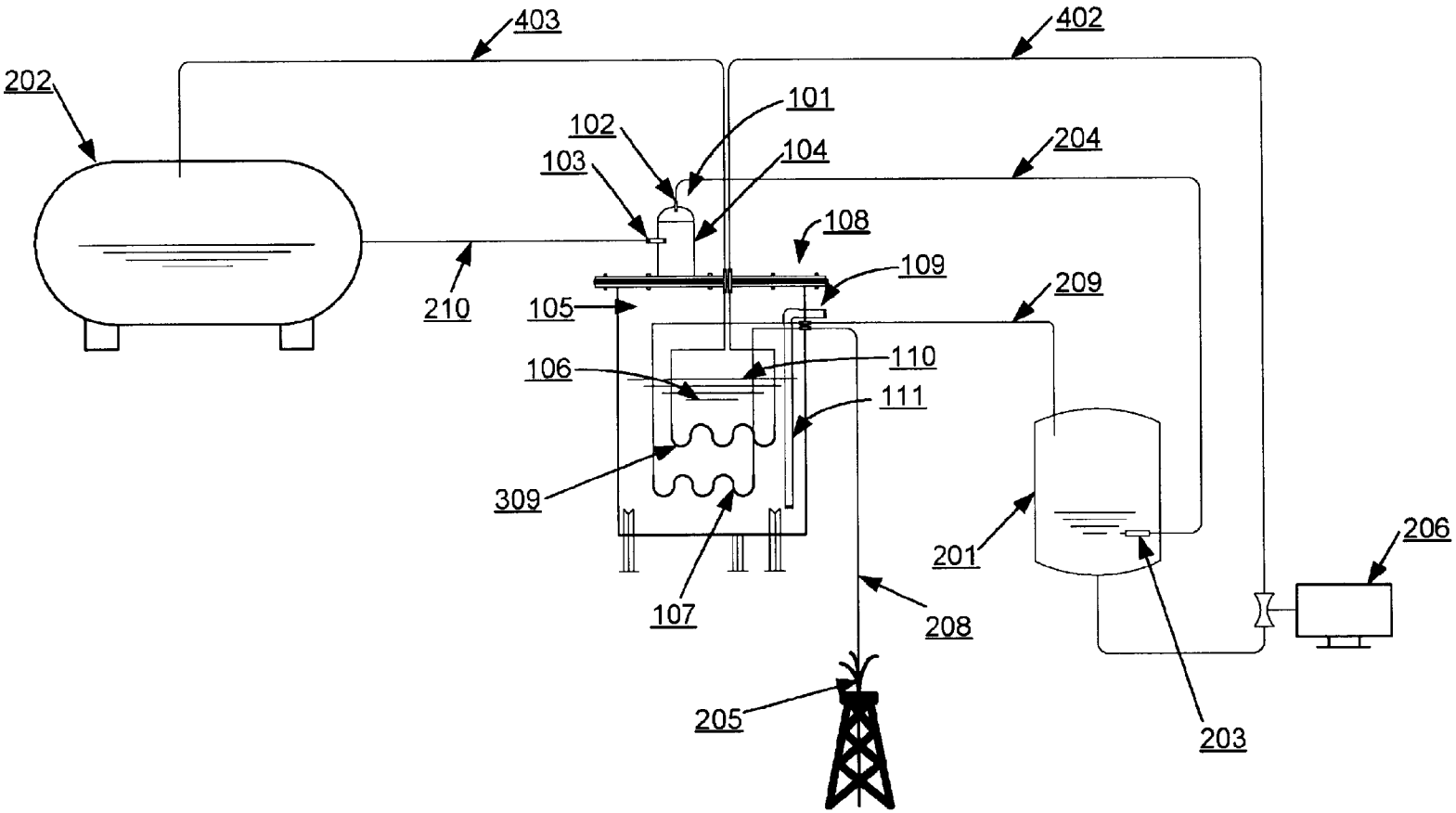
FIG. 4 illustrates the operation of a second heating coil according to one embodiment of the present invention.

In accordance with a further embodiment of the present invention, a second heat transfer device, in this example a heating coil 309 (shown in FIG. 3) is provided in the blowdown recovery vessel 108. As shown in FIG. 4, this heating coil 309 receives boiler feedwater, pumped by the boiler feedwater pump 206 through a conduit 402, and passes it through the boiler blowdown mass 106, in the storage section 105 of the blowdown heat recovery vessel 108, and then directs it through another conduit 403 to the steam boiler 202. This allows the feedwater to pick up additional heat energy before entering the steam boiler 202.

Overall, through this process, substantially all the flash steam energy is recovered and the sensible heat left in the resulting boiler blowdown water is transferred to cooler water streams, such as make-up water and boiler feedwater.

The level 110 in the storage section 105 is maintained via a water level control system. As the water level 110 rises, overflow would normally occur from the top of the tank. However, the conduit 111 connects the loop drain 109 to a lower water level in the storage section 105. This allows the water level control system to remove water from the bottom of the vessel 108, where it is cooler, and release it to normal sewer drain, versus removing the hotter water at the top gradations. This method for controlling the water level 110 in the storage section 105 is efficient for preserving thermal energy.

What is claimed is:

1. A method of recovering heat energy during blowdown of a steam boiler, comprising:

providing a supply of feedwater to replenish water in said steam boiler during blowdown;

removing blowdown water from said steam boiler;

producing flash steam from said blowdown water;

transferring thermal energy contained in said flash steam to a mass of water for recovery of said thermal energy contained in said flash steam; and transferring thermal energy remaining in said blowdown water after production of said flash steam to said feedwater.

2. The method of claim 1, wherein said mass of water is said feedwater, said thermal energy contained in said flash steam thereby being transferred directly to said feedwater.

3. The method of claim 1, wherein said mass of water is a separate body of water in an open vented tank.

4. The method of claim 1, wherein said blowdown water is transferred from said boiler to a flash chamber to generate said flash steam, and said flash steam is fed from said flash chamber into said mass of water so as to condense therein.

5. The method of claim 4, wherein said blowdown water flows from said flash chamber into a blowdown recovery vessel, and fresh make-up water flows through a heat exchanger immersed in said blowdown recovery vessel to recover thermal energy therefrom and said make-up water thereafter flows from said heat exchanger into a feedwater tank to provide a supply of said feedwater.

6. The method of claim 5, wherein said feedwater flows directly from said feedwater tank to said steam boiler.

7. The method of claim 5, wherein said feedwater from said feedwater tank is passed through a second heat exchanger in said blowdown recovery vessel prior to flowing into said boiler so as to absorb additional heat from said blowdown water after from the release of said flash steam prior to flowing into said steam boiler.

8. The method of claim 5, wherein any overflow water in said blowdown recovery vessel is extracted from near the bottom of said blowdown recovery vessel.

9. A blowdown apparatus for use with a steam boiler, comprising:

a flash chamber for producing flash steam from blowdown water from a steam boiler;

a conduit for directing said flash steam into a tank containing a mass of water so as to transfer heat energy contained in said flash steam to said mass of water and thereby permit recovery of said heat energy contained in said flash steam;

a blowdown recovery vessel for containing blowdown water after the release of said flash steam;

a feedwater tank for containing a supply of feedwater to replenish water in the steam boiler; and a heat exchanger for transferring heat energy from said blowdown water to make-up water flowing into said feedwater tank.

10. The blowdown apparatus of claim 9, wherein said tank containing a mass of water is said feedwater tank so that said heat energy contained in said flash steam is transferred to said feedwater.

11. The blowdown apparatus of claim 9, wherein said tank containing a mass of water is an open vented tank.

12. The blowdown apparatus as claimed in claim 9, wherein said conduit feeds said flash steam directly into feedwater in said feedwater tank so that said flash steam condenses therein.

13. The blowdown apparatus as claimed in claim 12, wherein said flash chamber is mounted on top of said blowdown recovery vessel so that blowdown water remaining after losing said flash steam drops down from said flash chamber into said blowdown recovery vessel.

14. The blowdown apparatus as claimed in claim 9, further comprising a second heat exchanger in said blowdown recovery vessel arranged so that feedwater from said feedwater tank flows through said second heat exchanger before flowing into said boiler.

15. The blowdown apparatus of claim 9, further comprising an overflow conduit terminating near the bottom of said blowdown recovery vessel so that overflow water is drawn from near the bottom of said blowdown recovery vessel.

* * * * *